US007254355B2

(12) United States Patent
Sahay

(10) Patent No.: US 7,254,355 B2
(45) Date of Patent: Aug. 7, 2007

(54) APPARATUS AND METHOD TO IMPROVE PRINTER PRODUCTIVITY

(75) Inventor: Ravi Bhushan Sahay, San Diego, CA (US)

(73) Assignee: Ravi B. Sahay, San Diego, CA (US)

( * ) Notice: Subject to any disclaimer, the term of this patent is extended or adjusted under 35 U.S.C. 154(b) by 150 days.

(21) Appl. No.: 11/133,913

(22) Filed: May 20, 2005

(65) Prior Publication Data

US 2006/0263110 A1 Nov. 23, 2006

(51) Int. Cl.
*G03G 15/00* (2006.01)

(52) U.S. Cl. ..... 399/82

(58) Field of Classification Search ..... 399/82, 399/2; 358/296

See application file for complete search history.

(56) References Cited

U.S. PATENT DOCUMENTS 4,782,363 A 11/1988 Britt
5,095,369 A 3/1992 Ortiz
5,452,068 A 9/1995 Farrell
5,697,040 A 12/1997 Rabjohns
6,213,652 B1 4/2001 Suzuki
6,470,156 B1 * 10/2002 Sahay ..... 399/82
6,606,163 B1 8/2003 Suzuki
6,850,336 B1 2/2005 Purvis
6,968,150 B2 * 11/2005 Ferlitsch ..... 399/403

* cited by examiner

*Primary Examiner*—Quana Grainger

(57) ABSTRACT

A method for improving productivity of a printer with in-line finisher, which includes the steps of: a) storing a sequence of jobs; b) printing the first print job; c) transmitting the printed portions of the first print job to the productivity module; d) unloading the printed portions in sequence from the productivity module and performing a finishing operation on the printed first portion of the first print job; e) during the step d), printing a portion of the second print job; f) transmitting the printed portions of the second print job to the productivity module; g) initiating printing of a second portion of the first print job, concurrent with step d), h) unloading the next printed portions of the first job in sequence from the productivity module and performing a finishing operation on the printed portions of the second print job; and continuing these sequences for the next print job.

3 Claims, 8 Drawing Sheets

APPARATUS AND METHOD TO IMPROVE PRINTER PRODUCTIVITY

CROSS REFERENCES TO RELATED APPLICATIONS

None.

STATEMENT REGARDING FEDERALLY-SPONSORED RESEARCH OR DEVELOPMENT

Not applicable.

BACKGROUND OF THE INVENTION

1. Field of the Invention

The present invention relates to a system for efficiently controlling a printing machine which is capable of producing collated sets for in-line finishing of books, proposals, manuals etc with very high productivity.

On-demand page printers, wherein images are created in response to digital image data submitted to the printing apparatus, are familiar in many offices. Such printers create images on sheets typically using electrostatographic or ink-jet printing techniques. In work-set situations, wherein different users at various personal computers and other terminals submit jobs to a single central printing apparatus, various sets of digital image data, corresponding to jobs desired to be printed by different users, are typically kept in an electronic queue, and a control system typically located at the printer sorts through the image data and causes the printer to output the desired prints in an orderly manner.

The terminology "copiers", and "copies", as well as "printers" and "prints", is used alternatively herein. The terminology "imaging" and "marking" is used alternatively herein and refers to the entire process of putting an image (digital or analog source) onto paper. The image can then be permanently fixed to the paper by fusing, drying, or other means. It will be appreciated that the invention may apply to almost any system in which the images are made electronically, including electronic copiers.

Imaging systems (e.g., printers or copiers) typically include copy sheet paper paths through which copy sheets (e.S., plain paper) which are to receive an image are conveyed and imaged. The process of inserting copy sheets into the copy sheet paper path and controlling the movement of the copy sheets through the paper path to receive an image on one or both sides, is referred to as "scheduling". Copy sheets are printed by being passed through a copy sheet paper path (which includes a marking station) one or multiple times. Copy sheets which are printed on only one side (simplex copy sheets) in a single color usually pass through the copy sheet paper path a single time. Multipass printing is used to print images on both sides of a copy sheet (duplex printing), or to print a simplex sheet in multiple colors (one pass for each color). Particularly with sophisticated printing apparatus, it may often be desired to print "duplex" prints, that is prints having images on both sides of the sheet.

However, most currently available printing devices are capable of producing an image only on one side of a sheet at a time. In order to obtain duplex prints, it is almost always necessary to provide an "inverter" within the printing device or apparatus. The purpose of an inverter is to handle a sheet after one side thereof has received an image, and in effect turn the sheet over to make the remaining blank side available to the same printing apparatus which created the first image. In effect, each duplex print is re-fed past the image-making portion of the printing apparatus so that the individual sheet becomes available to the image-making apparatus twice, once for each side.

In an electro-photographic printing apparatus, wherein images are first created on a photoreceptor in the form of a rotating drum or belt and then transferred to sheets, a key concern is the presence of blank pitches (image-sized spaces) along the drum or belt where, for various reasons relating to the long time required to finish (bind) a set, when no image is created to allow for finisher to complete its operation. The problem with blank pitches is that each blank pitch represents lost productivity. In some cases when the number of sheet in a set are small, the number of blank pitches along the belt may be comparable to the number of pitches actually having images on them. In such a situation, not only is the apparatus effectively running at half-speed, but various mechanical parts associated with the drum or belt will be experiencing wear to no productive purpose. Thus, as a general rule, the overall productivity and reliability of such a printing apparatus is inversely related to the number of blank pitches which result in the printing process.

It is generally known that electronically inputted printers can desirably provide more flexibility in page sequencing (page, copying presentation order) than copiers with physical document sheet input. The printer input is electronically manipulatable electronic page media, rather than physical sheets of paper which are much more difficult to reorder or manipulate into a desired sequence. As also shown in the art noted hereinbelow, it is generally known that certain such reordered or hybrid document page copying orders or sequences may be copied onto a corresponding sequential train of copy sheets in an appropriate copier or-printer to provide higher copying machine productivity yet correct page order copy output, especially for duplex copies made with a copier with trayless duplexing, i.e., providing a limited length endless buffer loop duplexing path for the copy sheets being duplexed.

2. Description of Related Art

It is becoming increasingly common to integrate on-line finishing devices with imaging systems. These on-line finishing devices directly receive copy sheets as they are output from the imaging system and perform various types of finishing operations on each copy sheet, or on each set of copy sheets. The finishing operations can be, for example: binding, stitching, folding, trimming, aligning, rotating, punching, drilling, slitting, perforating, and combinations thereof.

A problem which arises when integrating an existing finishing device with high speed imaging systems is that the finishing device may not be able to receive copy sheets at as high a frequency as the copy sheets can be output by the imaging system. For example, the imaging system described in U.S. Pat. No. 5,095,342 can output copy sheets at a rate of 135-180 per minute when operating in "burst mode". This rate is too fast for some finishing devices.

One example involves the use of the imaging system disclosed in U.S. Pat. No. 5,095,342 in connection with an on-line Signature Booklet Maker (SBM) to form signature booklets. A "signature" is a duplex printed copy sheet having two page images on each side. The signature sheet can be folded in half to form a booklet, or a plurality of signatures can be aligned, stitched together, and folded in half to form a multi-sheet booklet. Descriptions of signature printing are provided in U.S. Pat. No. 4,727,042 to Smith and U.S. Pat. No. 5,271,065 to Rourke et al., the pertinent portions of which are incorporated herein by reference. The imaging system disclosed in U.S. Pat. No. 5,095,342 is capable of outputting signatures in bursts at a rate of 135 per minute, but the SBM may not be able to receive sheets at such a high rate.

A sheet scheduling approach that compensates for the disparity in sheet handling capabilities of the imaging system and a finishing device, such as the Signature Booklet Maker (SBM), is disclosed in U.S. Pat. No. 5,159,395 to Farrell et al., the pertinent portions of which are incorporated herein by reference. In particular, U.S. Pat. No. 5,159,395 discloses a printing system that operates in one of two modes, depending on whether sheets are being delivered to the SBM. In the first mode, printed copy sheets are output from a copy sheet path of the printing system without any skipped pitches. The first mode of scheduling provides the maximum output (and thus productivity) of the printing system. If, however, the output frequency of the first mode is too great for the finishing device, a second, slower mode of operation results. In the second mode of operation, sheets are output from the printing system with skipped pitches located between at least some of the consecutively output sheets.

Another approach which compensates for the disparity in sheet handling capabilities of the imaging system and a finishing device is disclosed in U.S. Pat. No. 4,782,363 to Britt et al. The system of U.S. Pat. No. 4,782,363 comprises a collating and finishing apparatus and method including a buffered design to allow more time to finish a copy set without halting copying. In a pre-collation copying mode, two bins at a time are utilized as the buffer for compiling while one or two other bins are awaiting being emptied for finishing, and then they function as the buffer for the next two copy sets, etc. A key feature of the system, which enhances productivity, is the sequential use of different pairs of three compiler bins in coordination with finishing so that while the second of one pair of copy sheets is being removed from a bin and finished, the first two sheets of the next sequence or set are entering two other now empty and available bins, in a continuous enter one side/exit the other side sequential operation.

Some examples of other prior art copiers, and especially with control systems therefor, including operator console switch selection inputs, document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156.

While the approaches of U.S. Pat. No. 4,782,363 and U.S. Pat. No. 5,159,395 enhance printing system productivity, each approach experiences loss of imaging system productivity under certain circumstances. Regarding U.S. Pat. No. 4,782,363, if a pair of bins cannot be emptied out by the time another set is to be delivered, then the imaging system must skip pitches. Regarding U.S. Pat. No. 5,159,395, the printing system operates in a degraded mode, in which pitches must be skipped, when sheets are being delivered to the finishing device. Regarding U.S. Pat. No. 5,452,068, an alternate output tray or an alternate finishing device is needed to improve productivity.

U.S. Pat. No. 5,452,068 describes a technique for finishing print jobs by scheduling for delivery to a portion of the first job to an in-line finisher and a second job, scheduled for delivery to a second destination (an output tray), in a manner that reduces productivity losses in a marking engine. A difficulty with prior art systems is an inability to prioritize jobs ready to print and to be able to run and complete one or several small jobs during the processing of a very high volume job and being able to blend jobs into the same finishing device.

It would be desirable, therefore, to be able to look ahead at a job queue, find one or more suitable jobs in the queue(for example, jobs that can be delivered to the same output device), and be able to concurrently run multiple jobs to improve productivity.

It is an object of the present invention, therefore, to be able to scan a job queue during the processing of a first job and while processing the first job, being able to intermix the concurrent processing of multiple jobs delivered to the same output (finishing) station.

However, it would be desirable to provide a system in which imaging system productivity is increased, relative to the above-discussed references.

It is well known in this art, and in general, how to program and execute document handler and copier control functions and logic with conventional or simple software instructions for conventional microprocessors in a copier controller. This is taught by the above and other patents and various commercial copiers. Such software may vary depending on the particular function and particular microprocessor or microcomputer system utilized, of course, but will be available to or readily programmable by those skilled in the applicable arts without experimentation, from either descriptions or prior knowledge of the desired functions together with general knowledge in the general software and computer arts. It is also known that conventional or specified document and copy sheet handling functions and controls may be alternatively conventionally provided utilizing various other known or suitable logic or switching systems.

BRIEF SUMMARY OF THE INVENTION

The present invention relates generally to a technique for processing print jobs and, more particularly, to an apparatus and method for printing and in-line finishing in a manner that reduces productivity losses in a marking engine.

The image forming apparatus assumes a supply means to supply the images, which has a built-in or programmed discrimination means to discriminate whether the document pages are one-sided or two-sided, and also to discriminate whether the pages are black and white or color. Then the image forming apparatus selectively outputs copy sheets in either a one-sided copy mode, two-sided copy mode, or mixed-sided copy mode to form collated sets that can be finished in-line.

This invention is an improvement over my earlier patents, U.S. Pat. Nos. 6,470,156 and 5,655,208, involving a productivity module apparatus adaptable to execute in-line finishing operations efficiently; in particular, for situations when the number of sheets in a set to be printed and finished are small (between 12-50 sheets per set) an the finishing time per set is long (usually more than 15 seconds per set). For example, a 12 sheet one-sided set will take only 4 seconds to print at 180 pages per minute in the "burst mode" whereas the finishing (binding) time can be much longer, as for example, which usually causes the printer to loose productivity.

Utilizing a productivity module (similar to U.S. Pat. Nos. 6,470,156 and 5,655,208) which utilizes multiple storage or buffer bins an unique job-sequencing algorithm, a preferred feature of this invention is to provide an efficient method for printing, storing, unloading, and delivering the sets from the buffer bin of the productivity module to the finishing operation.

U.S. Pat. No. 6,470,156 describes printing short runs of personalized images with variable-data (as for example, single set of invoices, bills, proposals, and reports for each original) containing a mix of single-sided and two-sided black and white or color pages by making a single copy of the said images in a sequence until the number of sheets is equal to the duplex loop length and which is equal to the minimum number of storage/buffer bins. In this regard single image printing of the documents is first performed (as a first succession or mode) until the two-sided paper path loop is filled. This is followed by the printing of the other side of a two-sided copy (as a second succession or mode) after which these printed copies are sent into intermediate storage/buffer bins, whose number is determined by the maximum number of copy sheets in the two-sided copy loop.

U.S. Pat. No. 5,655,208 describes printing short runs of books, manuals etc. containing a mix of single-sided and two-sided black and white or color pages by making identical multiple copies of the said images in a sequence until the number of sheets is equal to the duplex loop length and which is equal to the minimum number of storage/buffer bins in the productivity module. In this regard multiple image printing of the first document is first performed (as a first succession or mode) until the two-sided paper path loop is filled. This is followed by the printing of the other side of a two-sided copy (as a second succession or mode) after which these printed copies are sent into intermediate storage/buffer bins, whose number is determined by the maximum number of copy sheets in the two-sided copy loop.

By combining the above-mentioned productivity module with another job sequencing algorithms, overall increased productivity, job flexibility, job integrity and full job recovery can be accomplished by the marking engine and the in-line finisher for both book printing and variable(personalized) printing applications.

BRIEF DESCRIPTION OF THE DRAWINGS

The above and other objects, features and advantages of the present invention will become more apparent from the following detailed description taken with the accompanying drawings in which.

DETAILED DESCRIPTION OF THE INVENTION

Figure 1:
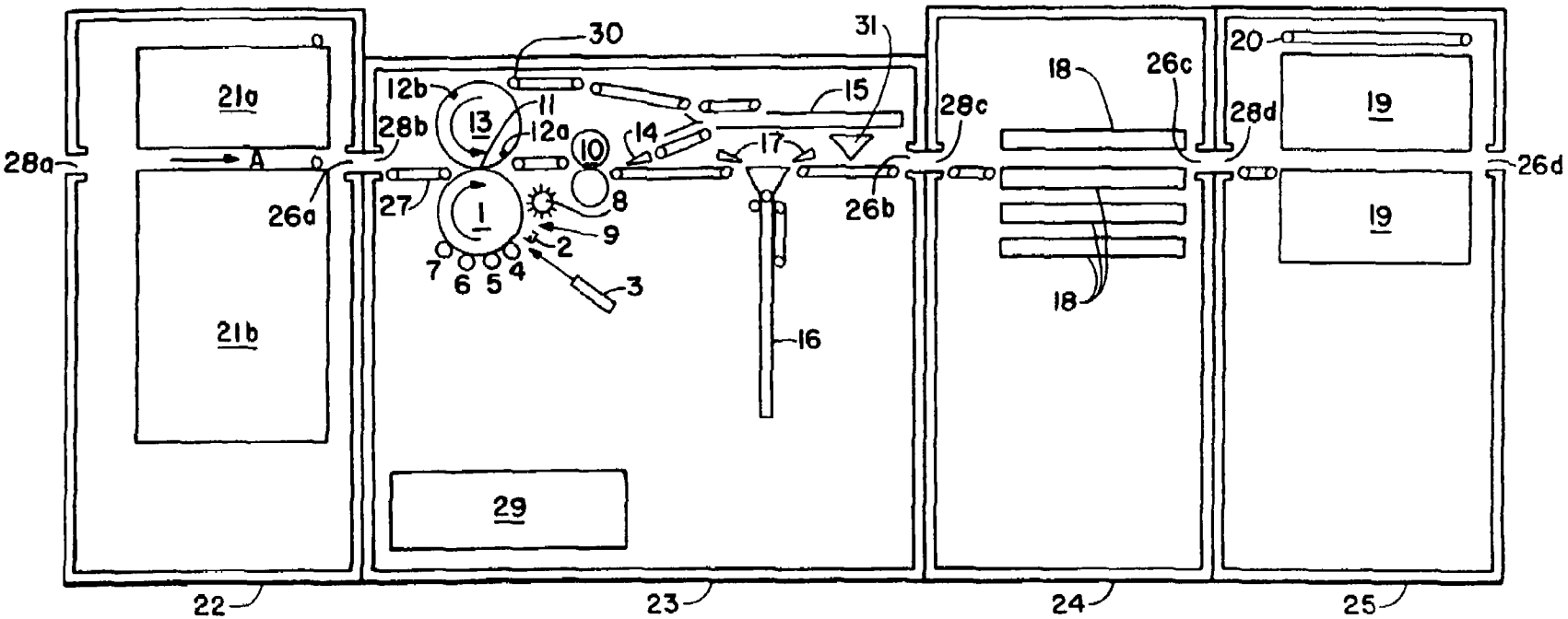
PRIOR ART FIG. 1
FIGS. 1 and 2 is a front view section showing an image forming apparatus adaptable to execute the present invention as prior art.
Figure 2:
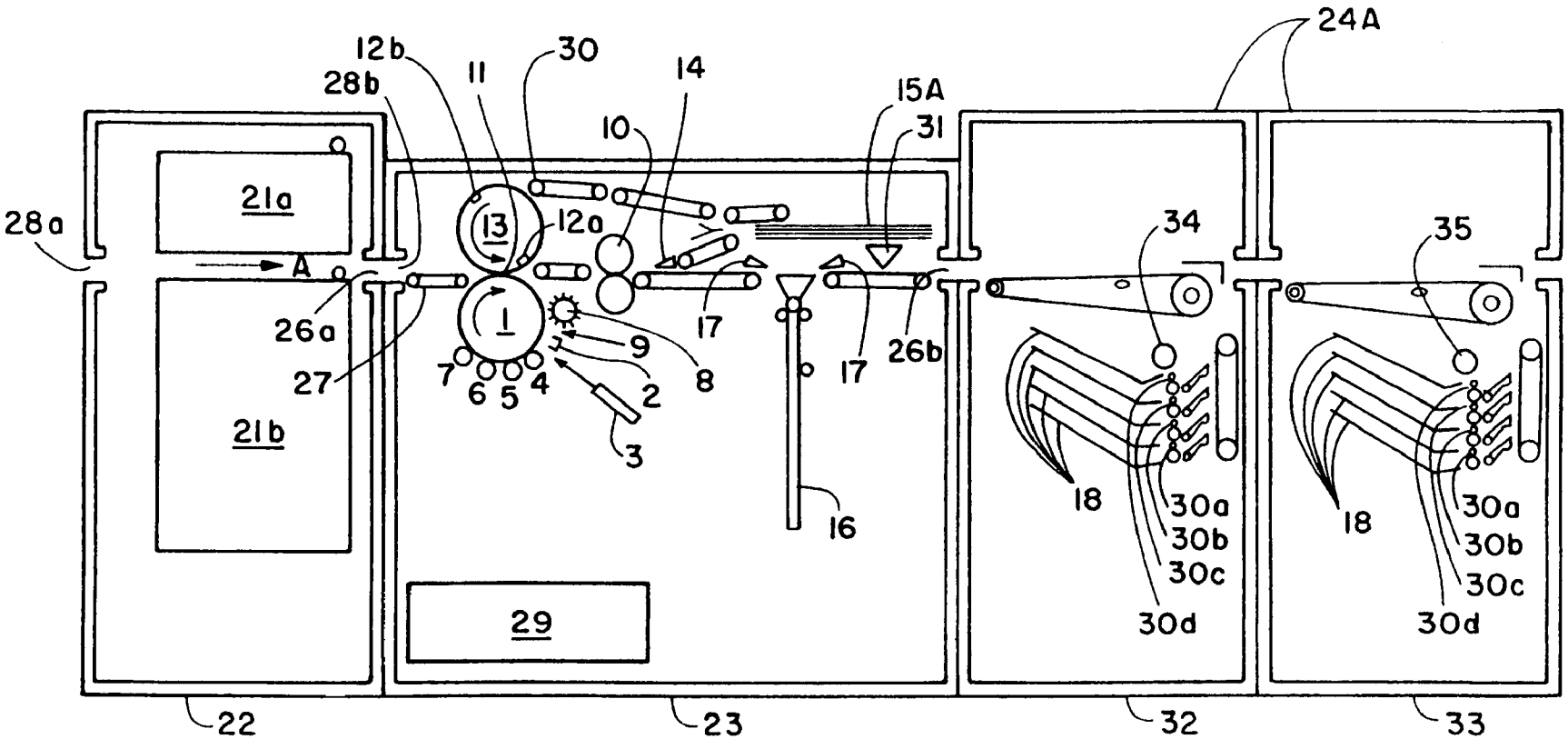
PRIOR ART FIG. 2

To facilitate understanding of my inventive method I will first describe it using structural components illustrated in FIGS. 1 and 2 as embodied in my prior patent, U.S. Pat. No. 5,655,208 (or '208) or U.S. Pat. No. 6,470,156 (or '156) and FIG. 3 as shown. This will later be followed by a description of the process with reference to the flow charts (FIGS. 4-6) which illustrate the process. It should be noted that the apparatus described and claimed in the '208 (or '156) is capable of executing the process of my present invention, but such execution by that apparatus will require much experimentation before it is successful. Referring to FIG. 1, a modular image forming apparatus adaptable to execute the present invention is shown and implemented as a digital copier/printer having an image writing device, developing devices, an image transfer device, a fixing device, a paper feeding device, a two-sided copy loop, paper transporting devices and an output stacking device. The apparatus is modular in that it consists of a linear arrangement of paper input module 22, followed by marking module 23, followed by productivity module 24, followed by output stacker module 25.

The exemplary xerographic copier/printer and its apparatus controller 29 as the apparatus discrimination means, shown in FIG. 1 will now be described in further detail. Two input paper trays 21 are shown in paper input module 22. Marking module 23 includes a photoreceptor drum or belt 1 and stations acting thereon for respectively charging 2, exposing 3, developing multiple colors 4, 5, 6, 7, transferring 11, cleaning 8, and erasing 9. Transferred images are fixed to the paper by passing the sheet through fusing station 10. The copier/printer is adapted to provide mixed one-sided and two-sided page-sequential copy sets comprised of black and white and color images. The control of sheet feeding is conventional, by apparatus controller 29. Apparatus controller 29 is a conventional programmable microprocessor which also controls all of the other apparatus functions described herein. Marking module 23 includes two registration wait gates, a first registration wait gate 27 and a second registration wait gate 30, a transfer drum 13 with two registration grippers 12, a two-sided copy gate 14, a two-sided copy inverter 15, exit inverter gates 17, and an exit inverter 16. Productivity module 24 contains, as an example, eight intermediate storage/buffer bins 18*a*, 18*b*, 18*c*, 18*d*, 18*e*, 18*f*, 18*g*,and 18*h* with storage/buffer bin sensors (30*a*, 30*b*, 30*c*, 30*d*, 30*e*, 30*f*, 30*g* and 30*h*) in each bin to detect the entry of paper.

Referring back to FIG. 3, clean copy sheets are first fed from one of the input paper trays 21*a* and 21*b* to the first to registration wait gate 27. The two paper trays can hold any type of copy paper. Typically, one tray holds one type of paper, such as, but not limited to standard 8½".times.11" or A4, while the other tray holds another type, such as 11".times.17" or A3. At the appropriate time, the sheet is re-fed to registration gripper 12*a* where the sheet is gripped and transported through xerographic transfer station 11 whereupon the transfer of a monochrome toner image from photoreceptor drum or belt 1 to one side of the sheet occurs. The copy sheet is mechanically registered against first registration gripper 12*a* and held against transfer drum 13 by static electricity forces. If a monochrome image is desired, first registration gripper 12*a* is released after transfer and the sheet passes into fusing station 10 for image fixing. Unless two-side copying is detected by the apparatus controller 29, the copy sheet is then advanced from the transfer station 11 to the second output port 26*b*. This is referred to as the first mode of operation and involves only a single pass transfer (multiple or single revolutions of photoreceptor 1) single color or multicolor copying. If multiple revolution, multiple pass transfer (on transfer drum 13) or two-sided copying is desired and detected by the apparatus controller 29, the process enters either one or both of what is referred to as the second mode of operation and the third mode of operation, respectively.

For multiple revolution, multiple pass copying, the color copying process is accomplished such that the cyan, magenta, yellow, and black images are separately transferred onto a sheet of copy paper and overlaid on each other sequentially during multiple revolutions of the photoreceptor drum 1 at the transfer station 11. Before each succeeding revolution, the photoreceptor 1 is cleaned. During each revolution, the charging station 2 and the exposing station 3 engage with the respective color development stations 4, 5, 6, and 7 to develop the image on the photoreceptor 1.

For multiple revolution, single pass transfer operation, the color processing is accomplished such that the cyan, magenta, yellow, and black images are overlaid on each other on the photoreceptor 1 sequentially during multiple revolutions of the photoreceptor 1. During each such revolution, the charging station 2 and the exposing station 3 engage with the respective color development stations 4, 5, 6, and 7 to develop the image on the photoreceptor 1. The developed color image is then transferred onto the sheet of copy paper only once at the transfer station 11.

In the single revolution, single pass transfer, the color processing is accomplished by adding multiple charging stations and multiple exposure stations for each separate color such that the cyan, magenta, yellow, and black images are overlaid on each other by the respective development stations 4, 5, 6, and 7 on the photoreceptor 1 sequentially during one revolution of the photoreceptor. The developed image is then transferred onto the sheet of copy paper only once at the transfer station 11.

For multiple-pass transfer color copying the sheet is held on transfer drum 13 by the registration means and is re-fed to the transfer station 1I until the desired number of colors is achieved followed by transport into the fusing station 10. Whereas for single revolution single pass transfer color copying or multiple revolution single pass transfer color copying, the copy sheet is fed to the transfer station 11 one time followed by transport into the fusion station 10. Unless two-sided copying was also detected, the copy sheet is advanced from the transfer station 11 to the second output port 26*b*. This is the second mode of operation. At least two copy sheets can be held onto the transfer drum 13 by the first registration gripper 12*a* and by the second registration gripper 12*b*.

For two-sided copying, after fusing, the copy sheets are fed to the two-sided copy gate 14 which functions as a one- or two-sided copy selector. Depending on the position of the two-sided copy gate, up or down, the copy sheets will either be deflected upward, with the gate down, into the two-sided copy inverter 15 or will continue straight, with the gate up, to the exit inverter gate 17 and out the second output port 26*b*. This is the third mode of operation.

In the event a two-sided copy is desired, the sheet is transported upward into two-sided copy inverter 15 and re-fed to second registration wait gate 30. At the appropriate time, the sheet is re-fed to first registration gripper 12*a* or second registration gripper 12*b*. The respective grippers are on substantially opposite diametric ends of each other. As a result of this configuration, the respective registration grippers provide the registration means for holding more than one sheet of copy paper at a time and assisting in the movement through transfer station 11. Each gripper can grip, hold, and move a sheet of copy paper. When a sheet is so gripped it is gripped and transported through xerographic transfer station 11 one or more times whereupon the transfer of a monochrome or colored toner image from photoreceptor drum or belt 1 to the second side of the sheet occurs. Upon complete image transfer, first registration gripper 12*a* is released after transfer and the sheet passes into fusing station 10 for second side image fixing.

Exit inverter gate 17 can now be employed to invert the sheet if an image-side-up copy sheet orientation is desired. In the event exit inverter gate 17 is closed, the copy sheet will be deflected downward into exit inverter 16 and re-fed to the second output port 26*b*. In the event the exit inverter gate 17 is open, the copy sheet will bypass the exit inverter 16, will be inverted, and then be acquired by the second output port 26*b* for final exit through transport 54 and 20 or for transport into one or more intermediate storage/buffer bins 18 through gate 50 and vacuum transport 52.

The fixed copy sheet is now transported into productivity module 24. The productivity module optimally contains a number of intermediate storage/buffer trays 18, the number being greater or equal to N. N is derived from the width of the copy paper being used or W and the length of the holding section or HS. An efficient value for N is about four to six copy sheets of standard size 8½".times.11" or A4 paper. For older printers, as for example, Xerox DocuTech, N is a value of about six such sheets and, for new printers, N is a value of about four such sheets, or their equivalent. The number of bins should be equal to or greater than the value N. The apparatus in this example has eight storage/buffer bins (18*a*, 18*b*, 18*c*, 18*d*, 18*e*, 18*f*, 18*g* and 18*h*), therefore, N=8.

Vacuum transport 52 is used to transport sheets from transport 52 to any selected one of multiple bins 18*a*, 18*b*, 18*c*, 18*d*, 18*e*, 18*f*, 18*g*, 18*h*, . . These storage/buffer bins are all used to compile and register sheets into completed copy sets. A separate gate (set of stripping fingers) is associated with each bin, as illustrated, to selectively deflect each sheet on the transport 52 into a selected bin (18*a*, . . . . or 18*h*). A known in-bin scuffer wheel system may be provided as illustrated to maintain stacking registration. These set of storage/buffer bins 18*a* . . 18*h* are driven (indexed) up and down as a module (note the illustrated dashed-line positions) by a bidirectional bin drive motor adapted to position to proper bin at the bin unloading position. A set unloading transport 42 may have, for example, a pair of set clamps mounted on two air cylinders and driven by four air valve solenoids. Two of the air valves are used for positioning the set transport and two are used for the retract function. Each bin preferably has a registration gate or pair of vertical stops at the unload side thereof which is automatically pivoted out of the way after the set clamp of the unloading transport 42 has grasped that set, so as to allow the set removal from the bin by horizontal movement of the unloading transport 42. The set transport 42 is used to transport sets from the bins to the finisher (binder/stapler) 44, and to the sheet stacking apparatus 19. The stitched, bound, or unfinished sets can be delivered to the stacking apparatus 19 where they are stacked for delivery to the operator.

Exemplary details of the other suitable copy set transports and finishing apparatus are described in references cited herein and elsewhere, including various means for reaching into a bin to grasp and remove a completed, compiled, collated, copy set therein.

Note that bin unloading desirably occurs at only one vertical position or level of the bins, to simplify set retrieval and finishing. Thus the bin set indexes up and down so as to place the bin containing the next completed set to be removed adjacent this unloading position, aligned with set unloading transport 42. But bin loading here can be done into any bin, in any position of the bins, and simultaneously with bin unloading. However, the controller 29 inhibits loading of a bin in the process of being unloaded, or a bin already containing a completed copy set.

It is important to note that sheets can enter bins either above or below the set ejecting level, and on either the up or down movements of the bins, even though the bin entrance velocities of the sheets will vary depending on the bin movement relative to transport 52.

To summarize, all eight storage/buffer bins index up and down as a unit between different unloading positions for unloading. Bin-unloading of compiled sets is from a single vertically fixed position adjacent the downstream sides of the bins. Each bin has its own independent gate, for variable loading. Incoming sheets are on the vertical sheet transport 52. There is no vertically fixed sheet entrance position and any bin can be loaded in any position of the bins. Thereby individual sheets can enter the bins either above or below the compiled set eject level (the unloading position), from the other side, and during both up and down cycles of the bins.

In this regard apparatus controller 29 houses a program which embodies and is adaptable to execute my process. With the foregoing as a background, reference now should be made to FIG. 4-6. The process calls for printing by job from a job queue—first, second, third and so on.

For reference purposes 'J' refers to 'Job'; 'S' refers to 'set'; and 'I' refers to 'image' with I.sup.A representing all I's in a set (S). A job (J) may consist of many images (I's). There may be more than one job; i.e., J.sup.1 through J.sup.n.

Job ordering in a job queue may be by least amount of time required to print a job, or by jobs containing the greatest quantity of images per set, or by which print job is most convenient based on the needs or desires of the user.

The controller 29 can be programmed to order the jobs by the finisher interval (i.e., that job containing the largest number of images. By way of example only and not by way of limitation, the minimum time required to complete the set with more than 45 images per set is 15 seconds at the speed of 180 pages per minute. However, if the number of images per set is only 12 then 4 seconds will be required to complete the set and 8 storage buffer bins will provide only 32 (4 times 8) seconds of printing which will be only sufficient to finish the first two sets in the finisher and machine will usually cycle down.

Now, in order to improve the productivity, the empty bins in the Productivity Module 24 could be used to print and collate the first set and more of the next chosen job while the finisher is finishing the remaining sets of the first job. The chosen job from the job queue has the largest amount of time required to print and collate the set. While the printer is printing the sets from the second (chosen) job, the finisher can print the portions (sets) from the first job. If there are more sets to be printed from the first job, the remaining sets from the first job can be printed as the storage/buffer bins become available. After all the sets from the first job is finished, the finisher 44 begins to process the sets from the chosen(second) job.

Taken together these conditions will minimize the number of skipped or lost process pitches and thereby maximize apparatus productivity. The apparatus controller 29 provides the logic means and the control means for detecting which operating mode should be engaged, how many copies are required, whether two-sided or single-sided, whether color or black and white, how many sets can be temporarily held in the storage/buffer bins in relation to how many intermediate bins N are contained within the productivity module 24 and for emitting a signal to each respective responsible structure to engage in the operations so detected. Maximizing use of the storage/buffer bins based on sequence of jobs in the queue will minimize the quantity of skip frames (pitches) associated with the printing and finishing of sets containing fewer images. In the above example, more than two jobs can be interleaved together in the storage buffer bins if required.

Figure 3:
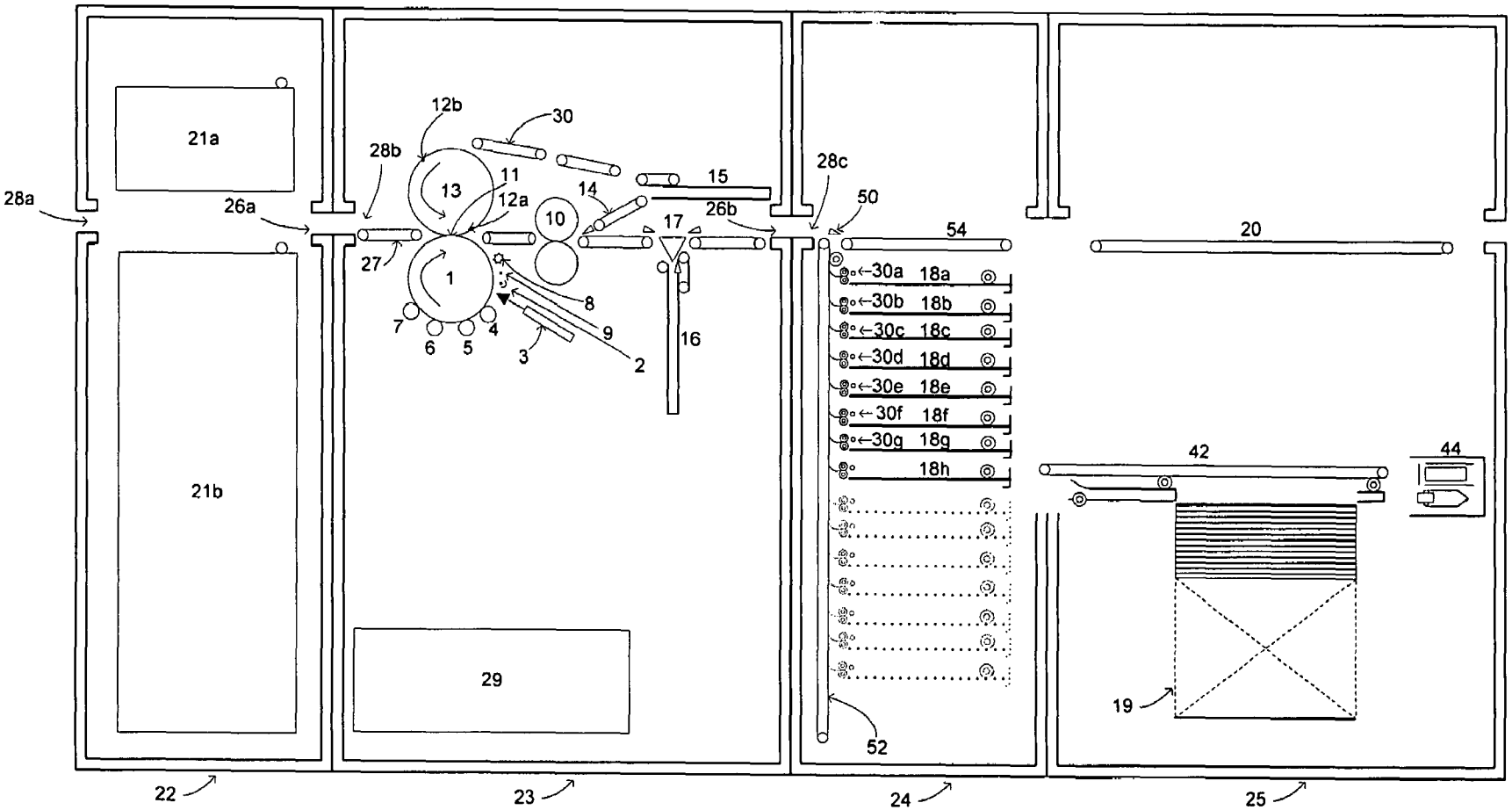
FIG. 3 is a front view section showing an image forming apparatus with In-line Finisher (Binder/Stapler) adaptable to execute the present invention.
Figure 4:
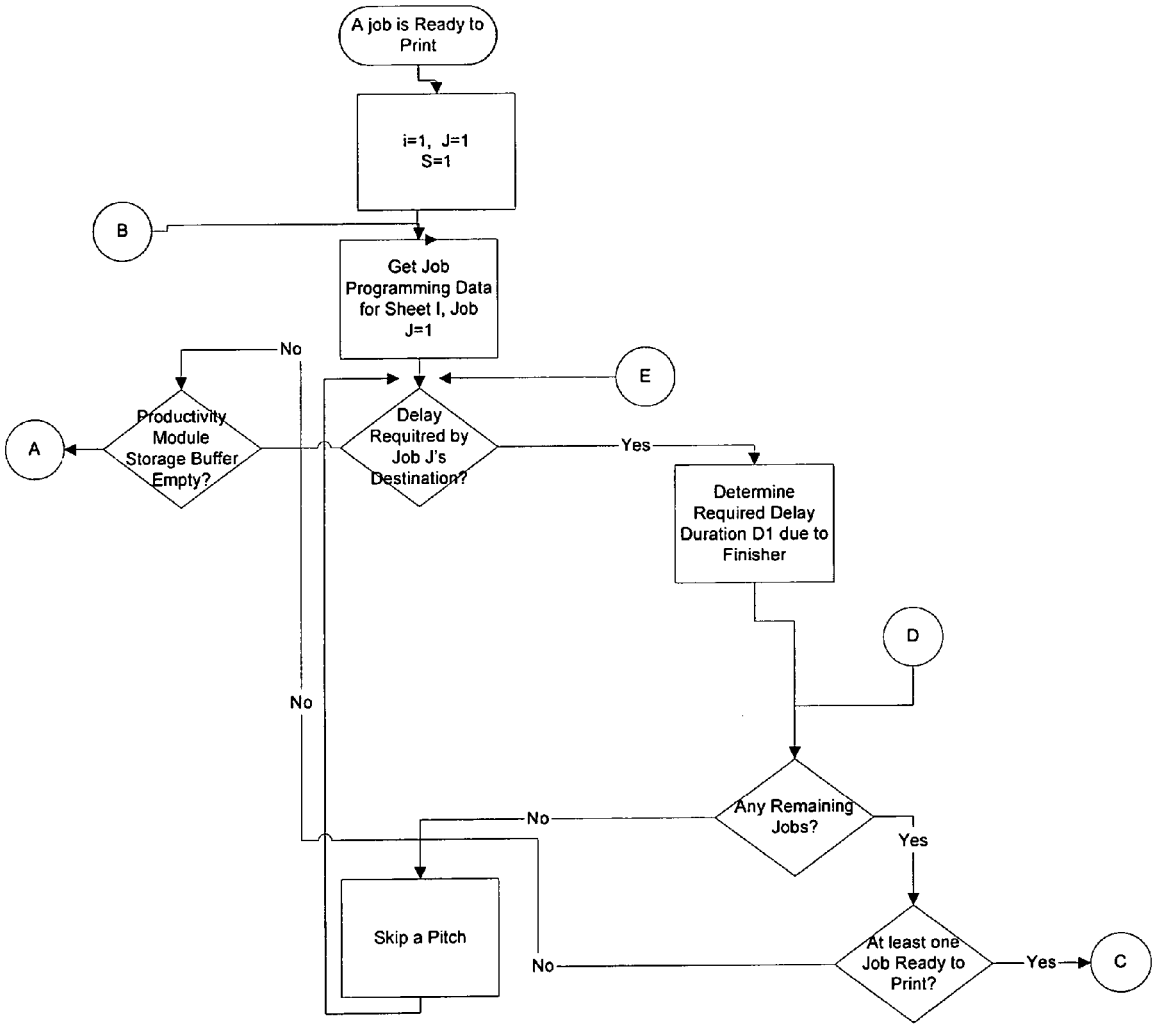
FIG. 4-8 are flow charts illustrating the process of the present invention.

Referring to FIG. 4, an exemplary scheduling arrangement which reduces the skipped pitches, and thus increases the productivity of the printer, i.e. the productivity of marking engine, is disclosed. In the following discussion of the exemplary scheduling arrangement, the term "scheduling" is used to designate the process of corresponding sheets to be marked with available pitches. As will be appreciated by those skilled in the art, scheduling a job in an electronic printing system, such as the exemplified printing system, results in one or more sets being marked, with the marking engine of FIG. 3, and delivered to a specified print output area, during the time interval(s) scheduled with the method described below. To provide a comprehensive view of the method of the preferred embodiment, an example, referred to as "present example" is interspersed throughout the current description. As a first step, Job J, in the present example (FIG. 4), is designated as being ready for printing. Job J is designated as the first job, i.e. J=1, while other jobs in the queue are designated as jobs 2, jobs 3 and so on respectively. To ready Job J for printing, the programming data for the lth sheet is acquired. In the present example, no delay is required for job J=1, so the process proceeds to a scheduling step A (FIG. 6) and scheduling of the sheets for the job proceeds, by way of steps shown in FIG. 4, until the Job J (=1) has been scheduled completely.

Figure 6:
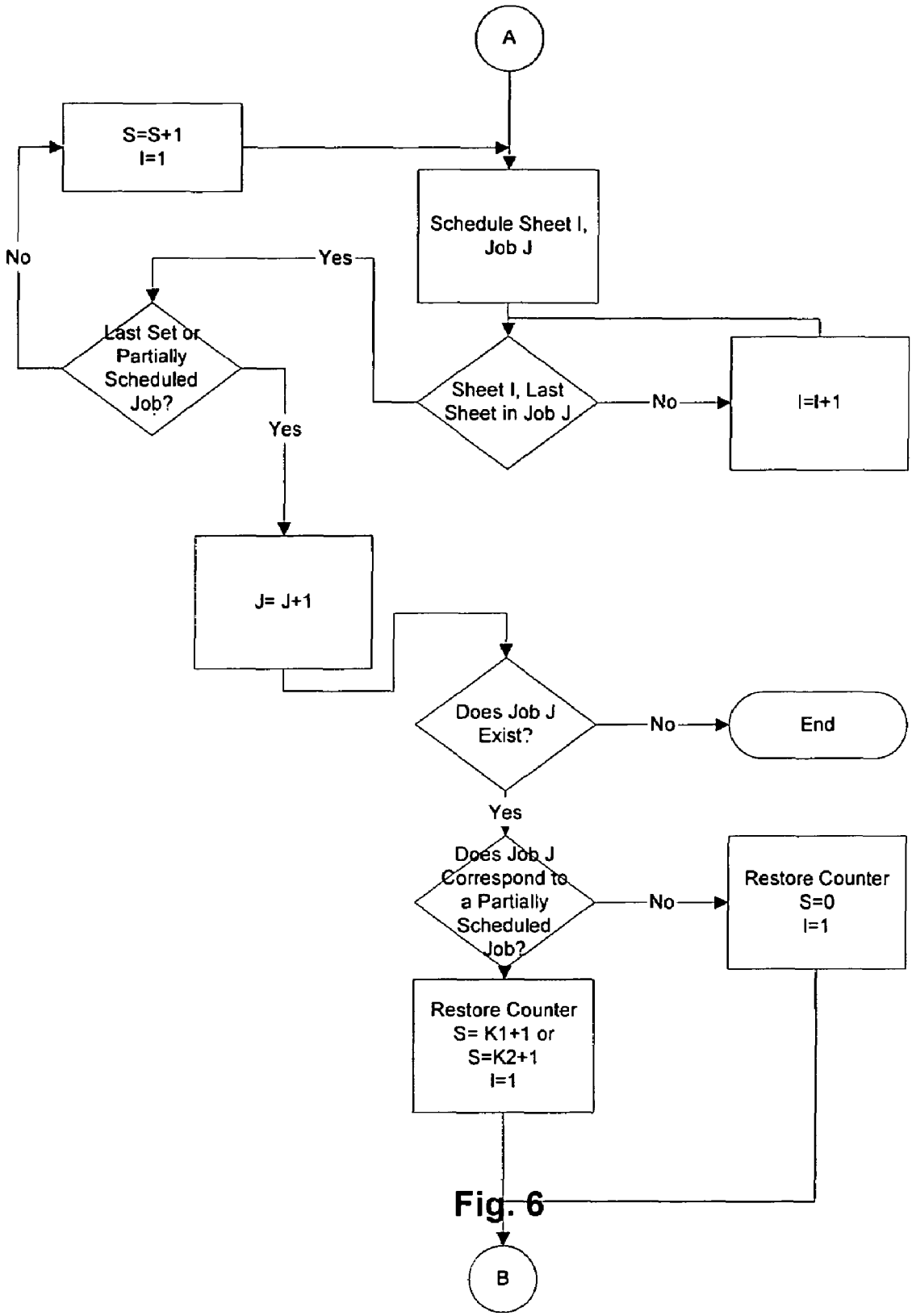

After Job J (=1) has been scheduled completely, the value of J is incremented, so that the next job in the print queue can be scheduled. Under certain circumstance, the print queue may be empty. Accordingly, a check is performed (see FIG. 6) to determine if there is a "next job" in the print queue. If the next job is a partially scheduled job, which means that the portion of the job was partially completed before (FIG. 6), then the scheduling is begun at a point within the job. That is, as will appear below, S varies as a function of a value equaling a last scheduled set in a chosen job (referred to below as J(=2)). If, on the other hand, the next job is a new job, then S is set to the value of 0. Additionally, the value of 1 is set at 1 (FIG. 6).

During the scheduling of job J(=1), a delay, dictated by the destination of job (due to finisher) will be encountered. That is, since this job is a multi-set job, whose sets are to be bound, a delay will arise after a predetermined number of sets have been transmitted to the Productivity Module 24 due to finisher 44 delay. In order to optimize printing during the delay created by finishing, the printing system controller 29, in accordance with the method of the disclosed embodiment, preferably schedules at least a part of a chosen job (J=2) to be printed during the delay, provided the printing of the chosen job partial portions (sets) can be achieved in a timely manner and the chosen job sets can be transmitted to one of the empty storage/buffer bin (18*a* . . . 18*h*) in the productivity module 24 so that these job portions (sets) can be stored temporarily in the respective bins and unloaded and finished later.

Prior to scheduling the chosen job, it is determined,(FIG. 4), the extent of a delay duration ("D1") that will arise as a result of one or more finishing operations to Job J (=1). As Job J is scheduled for marking, a gap in time, representative of D1, will occur due to the long finishing interval. By reference to the gap, the controller 29 is able to determine the magnitude of D1. Next, (FIG. 4), the process locates a job in the print queue that would take a long time to complete the first set and is scheduled to be printed and delivered to finisher. This job could have very large number of images (I's) in each set. Step C (FIG. 5) serves as a returning point so that the process can be repeated as additional delays in the scheduling of Job J arise. In the present example, a suitable chosen job (J=2) is present. If a suitable job had not been present with long processing time per set, however, then an appropriate number of pitches would have been skipped until the delay, created by the finishing process, expired.

Figure 5:
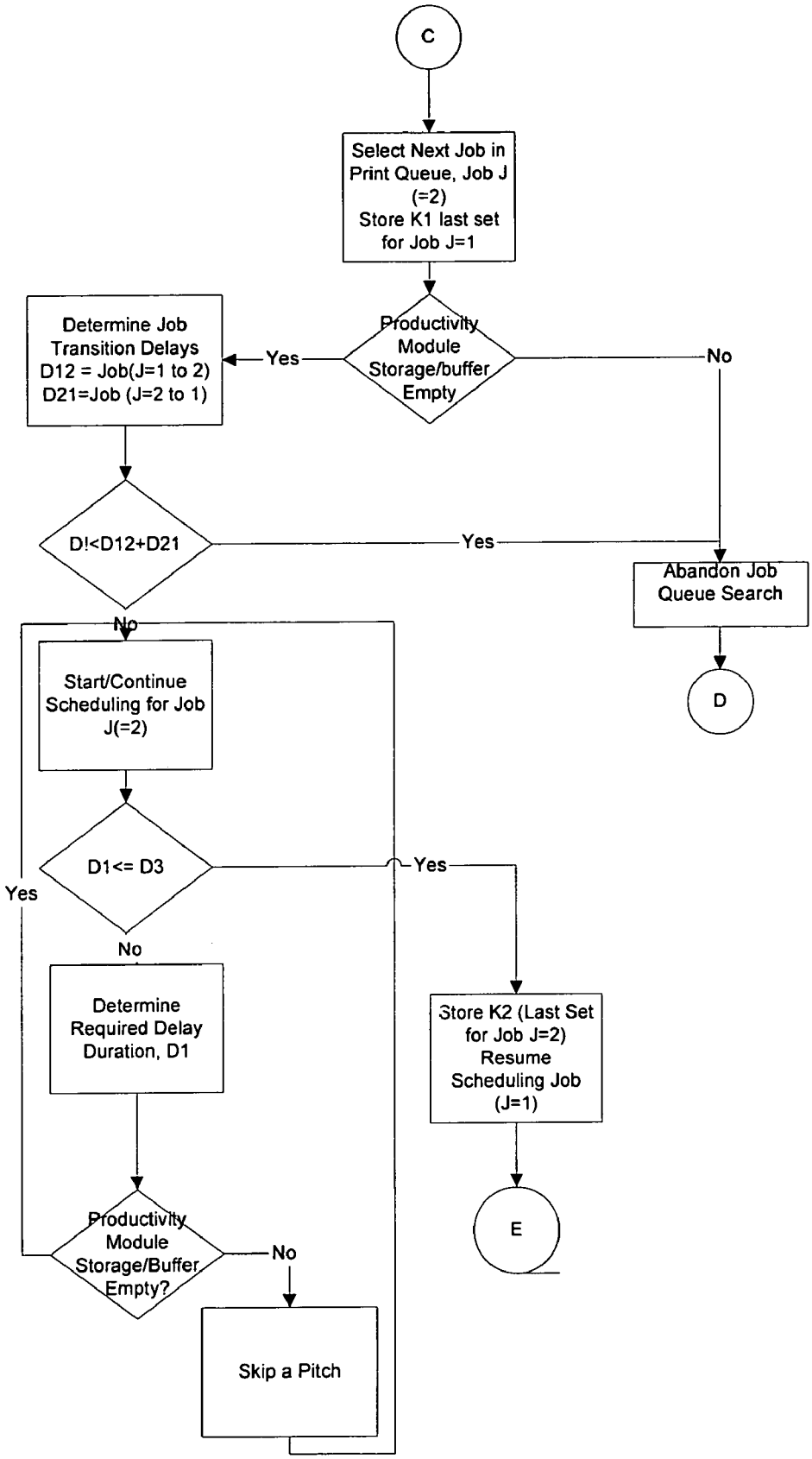

Continuing with the present example, after at least a portion of the chosen job (J=2) has been scheduled, and selected as the next job in the print queue with destination into one of the empty storage/buffer bin (18*a* . . . 18*h*), beforehand, it is determined whether the destination storage/buffer bin is empty. If the destination storage/buffer bin is not ready, then, as indicated in FIG. 5, the process is routed to controller 29 to "skip a pitch" and look into to determine if any more candidate jobs remain and the storage/buffer bins becomes available. Corresponding job transition delays to set up the photoreceptor for the Chosen Job (J=2) and the time required to reset the photoreceptor for Job J(=1), D12 and D21 are respectively determined. Setting up of the photoreceptor, in one example, constitutes changing the pitch mode of the photoreceptor to accommodate for the particular stock of a job.

To determine if it is feasible to schedule the chosen Job J (=2), the value of D1, determined earlier(FIG. 4) is, compared to the sum of D12 and D21. If the sum of D12 and D21 is greater than D1, then the currently chosen Job is abandoned (FIG. 5) and process controller 29 loops back to check for remaining jobs in the queue. On the other hand, if the sum of D12 and D21 is less than D1, and the storage/buffer bin is available, then, the scheduling of Job (J=2) is started or continued, whichever the case may be. Before switching the jobs from (J=1) to (J=2), the set counter K1 for Job (J=1) is stored in the memory. At one moment in time, the scheduling of Job J(=2)is started at the first sheet and the first set of Job (=2), but if several delays are encountered in Job J(=2), due to, for example, the finishing of multiple sets of Job J(=1), and the availability of the storage/buffer bins, then scheduling of Job (=2) may be stopped, temporarily, and continued several times after each set is completed in the storage/buffer bin.

As scheduling proceeds, the magnitude of D1 will decrease (FIG. 5) and, there will, eventually, be a demand to switch from Job (J=2) to Job J(=1), if the time required to switch from Job (J=2)to Job (J=1), i.e. D21, is greater than or equal to D1. If D21 is less than D1, then scheduling continues for Job (J=2) with the magnitude of D1 being re-determined(FIG. 5). If D21 is greater than or equal to D1 (FIG. 5), a value corresponding to the last set scheduled for Job J(=2), namely K2, is stored in memory and the scheduling of Job J(=1) is resumed after restoring the set counter K1 from the memory. After a selected number of sets have been scheduled for Job J(=1), the process controller 29 will look (FIG. 4) to determine if further set interleaving in the Productivity Module is required as a result of delay(s) in Job J(=1).

It follows from the discussion above that the process of FIGS. 4-6 can proceed to finish Job (J=1) prior to completing the scheduling of a partially scheduled Job (J=2). In another embodiment, the scheduling of a partially scheduled Job J would be completed prior to proceeding to a next Job (J=3). An advantage of this embodiment is that it would result in the clearing of the output stacking area 19 associated with each Jobs (J=1,=2,=3 . . ) and it would reduce job tracking complexity.

Additionally, while the discussion above relates to delays in scheduling due to finishing, delays can arise as a result of other events. Two examples of such events may be encountered in a printing system. In a first example, a delay is created by a start-up time of a vacuum blower (not shown), the vacuum blower being preferably associated with the paper feeder 52 of FIG. 3. That is, when the feeder 52 is to be employed, a signal is transmitted to the feeder and the vacuum blower is turned on. In the time that it takes the blower to "get up to speed", a delay, in which sheets from the candidate job can be scheduled, in accordance with the above-disclosed method, is generated. In the second example, a delay is created as a result of formatting a network job. As will be appreciated by those skilled in the art, a network job may not necessarily stored in a form that permits it to be printed as soon as it is called up from the print queue. More particularly, in certain known printing systems, several pitches may pass by before the network job is suitably formatted for printing. Several sheets of a chosen job from the job queue can be scheduled for printing during this delay of the network job.

Figure 7:
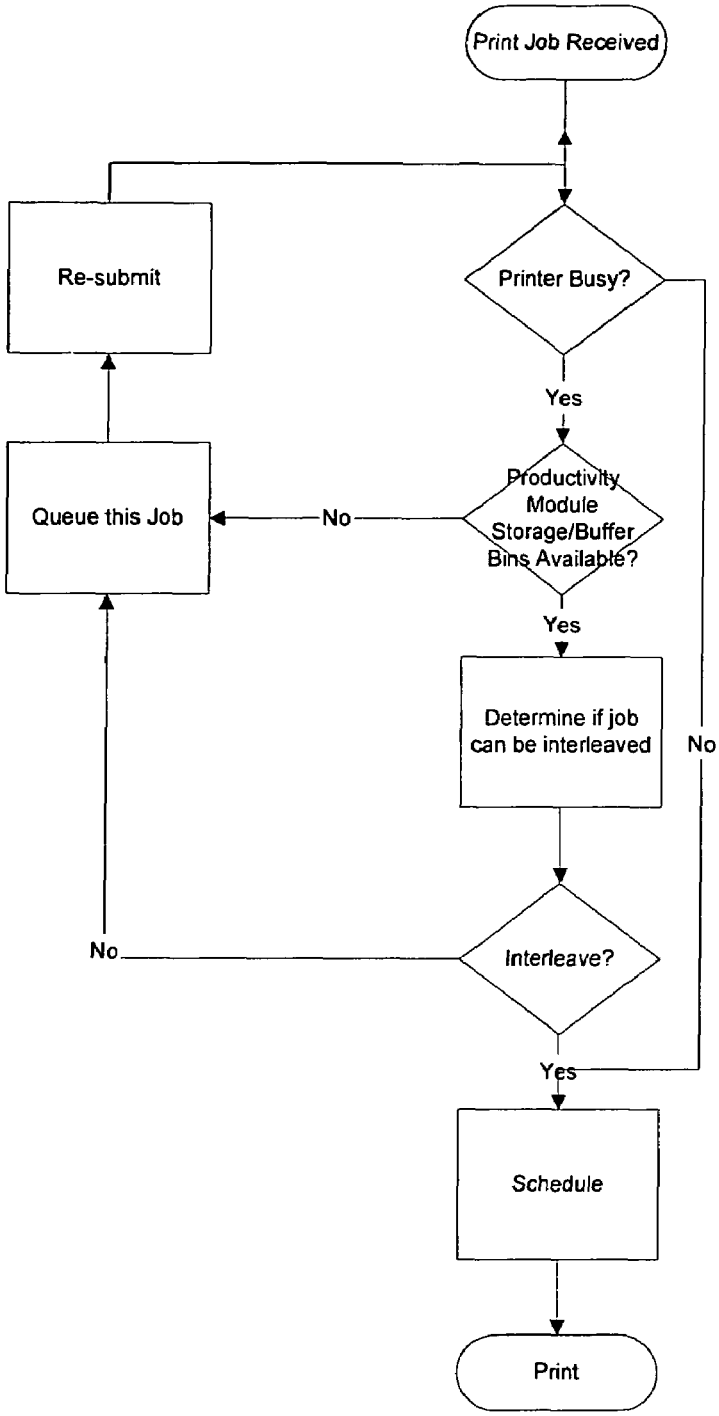

FIG. 7, illustrates another scenario for interleaving jobs to eliminate job transition delays during printing in accordance with the present invention. A job queue is scanned and the determination is made that there are jobs, one or many, that can be interleaved with a current job being printed. A determination that a job(s) can be interleaved as contemplated, is similar to the considerations shown in FIG. 8. If the job queue includes only a single job that can be interleaved as illustrated in decision, and a determination is made that a destination (productivity module storage/buffer bin) is available, then the job to be interleaved is scheduled as shown. On the other hand, if there are multiple jobs that can be interleaved, in a preferred embodiment, the top priority job (J=1) is scheduled for interleaving first.

Figure 8:
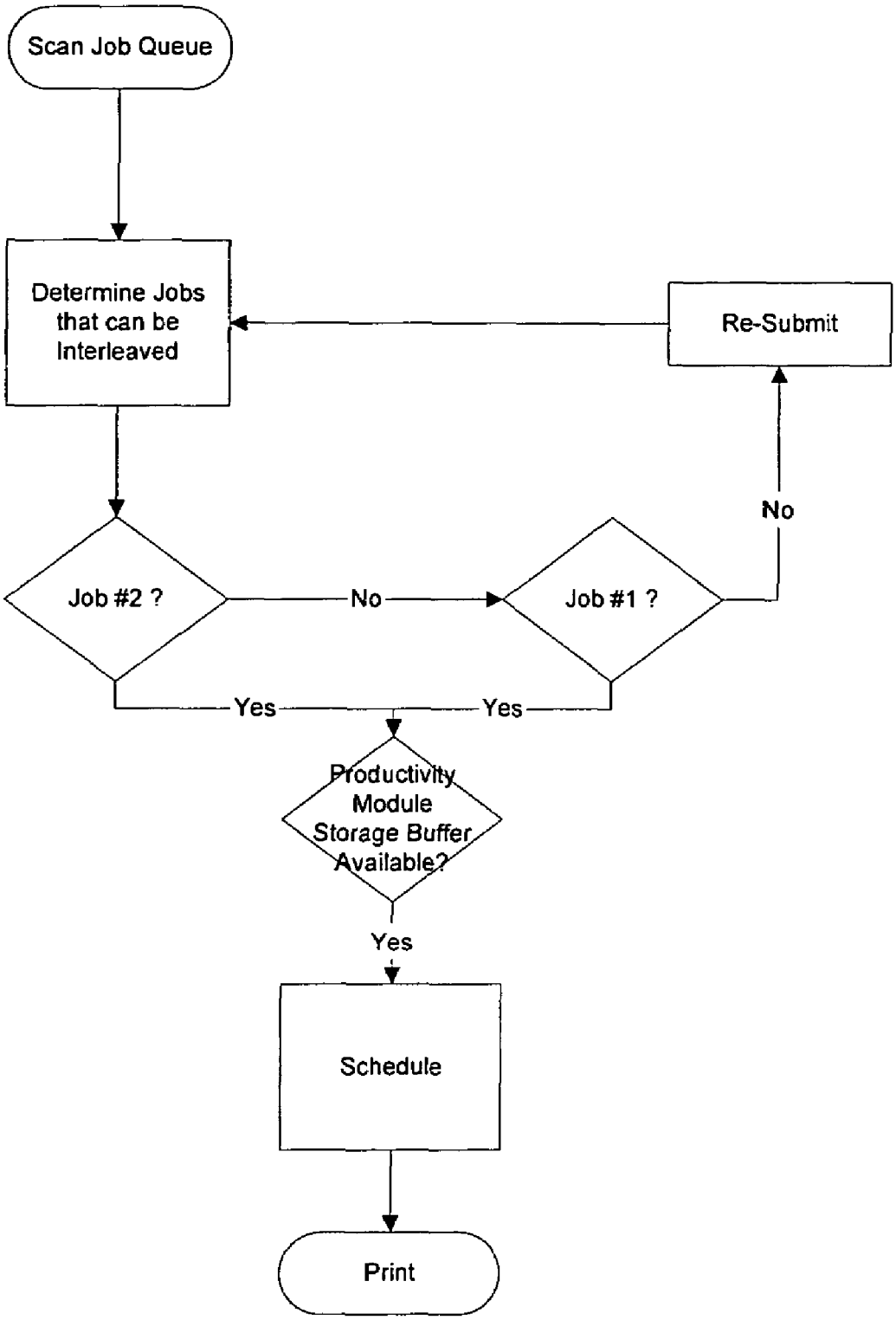

Various levels of priority of jobs are contemplated within the scope of the present invention. The jobs in the queue can be scanned to determine priority, and if a job is not a top priority job or the highest priority in the queue of jobs, then it is resubmitted as a candidate for interleaving. On the other hand, once the highest top priority job is determined, there is a determination as to whether or not there is an available destination (Productivity Module storage/buffer bin). If there is an available destination, then the top priority job is scheduled for printing as shown in FIG. 8.

If no destination is available, then the job must be resubmitted as shown in FIG.7 as a candidate for a job that can be interleaved. It should also be understood that once the top priority job (J=1) is determined as shown in FIG. 8, the next highest priority job can also be scheduled for interleaving as long as there are suitable storage/buffer bins are available for the third job. It should also be understood that the rate of scheduling an interleave job can be dependent upon the relative priorities of the jobs being interleaved as well as dependent upon the nature of the job currently being printed. For example, a job to be interleaved can be processed at the rate of one page for each page of the job currently being processed, one page for every five pages of the job currently being processed, one page for every ten pages of the job currently being processed, two pages for every one page of the job being currently processed, or any other frequency suitable to the priorities and conditions of the job in process as well as the other jobs in the job queue available to be interleaved.

With the abovesaid invention for job sequencing and the use of the productivity module 24, the printing and in-line finishing of jobs can be executed at the highest productivity. A second important system benefit results from use of said productivity module 24. As has been pointed out in my earlier patents, U.S. Pat. Nos. 6,470,156 and 5,655,208, involving a similar productivity module apparatus is adaptable to print mixed color and monochrome images or one-sided and two-sided images very efficiently for both book mode or variable(personalized) printing using novel sheet sequencing algorithms.

FIG. 3 is a simplified elevational view of the on-demand printing apparatus with in-line finishing, capable of simplex or duplex output, in which a stream of digital video signals representative of images desired to be printed causes the desired images to be formed on a selected side of a print sheet. The particular architecture shown in FIG. 3 is for an electrophotographic printer adaptable of executing my process. It must be understood, however, that the principle of the invention could apply equally to other types of image-creation technologies, such as ink-jet printing or other variants of electrophotographics, as for example tri-level hi-light color or tandem (dual) engine architectures.

It will be noted that the specifically electrostatographic aspects of the apparatus shown in FIGS. 1, 2 and 3, such as the photoreceptor 1, charging and exposing stations 2 and 3, and the developing stations 4, 5, 6 and 7, could be replaced by equivalent elements and be capable of creating images and be adaptable to execute my process. As an example, an ink jet printer may be used rather than what has been illustrated in FIGS. 1, 2 and 3. It must be further understood that FIGS. 1, 2 and 3 are for illustration purposes only, and not by way of limitation. Additionally, if the original source of images to be created are themselves a set of automatically fed hard-copy images, i.e., if the printing system as a whole is operating as a copier, the feeding of originals will also create certain constraints on the optimal order of images created with the printer. It is probably preferable to digitize (convert to digital signals) the original hard-copy images, electronically store the resulting data, and apply the data as required to a digitally-based exposing station 2.

The present disclosure includes that contained in the present claims as well as that of the foregoing description. Although this invention has been described in its preferred form with a certain degree of particularity it is understood that the present disclosure of the preferred form has been made only by way of example and numerous changes in the details of construction and combination and arrangement, of parts and method steps may be resorted to without departing from the spirit and scope of the invention. Accordingly, the scope of the invention should be determined not by the embodiment[s] illustrated, but by the appended claims and their legal equivalents.

The invention claimed is:

1. A printing system having a marking engine, for producing prints, and a finishing device operatively coupled with the marking engine, for performing a finishing operation on prints produced with the marking engine, wherein the marking engine experiences productivity losses due to a plurality of time intervals as a result of performance of the finishing device, said printing system comprising:

(a) memory means for storing a plurality of print jobs comprising a first print job and one or more subsequent print jobs wherein each print job comprises a first set, one or more or no sequential subsequent sets, and a last set wherein any said print job may comprise said first set as being said last set in jobs where there are no sequential subsequent sets, and each set comprises one or more images;

(b) a productivity module having more than one storage bins for receiving and storing said first set and said sequential subsequent sets of said first print job and for simultaneously receiving and storing a first set and sequential subsequent sets of a second print job, said productivity module connected to the finishing device and operatively coupled with the marking engine; and (c) a controller in communication with said memory and said marking engine for monitoring said plurality of print jobs and transmitting the first set and the sequential subsequent sets of said first print job to said productivity module for finishing and unloading; for calculating receipt times and output times associated for each set of said first print job thereby establishing if said productivity loss will be encountered and if said productivity loss will be encountered, preserving one or more of said more than one storage bins as open bins unavailable to receive additional said sequential subsequent sets from said first print job; directing the first set of the second print job to said one or more open bins for finishing and uploading after completion of said last set of said first print job.

2. The printing system of claim 1 further comprising transmitting the first set and the sequential subsequent sets of said second print job to said productivity module for finishing and unloading; wherein said controller calculates receipt times and output times associated for each set of said second print job thereby establishing if said productivity loss will be encountered and if said productivity loss will be encountered, preserving one or more of said more than one storage bins as open bins unavailable to receive additional said sequential subsequent sets from said second print job; directing the first set of a sequential subsequent print job to said one or more open bins for finishing and uploading after completion of said last set of said second print job.

3. The printing system of claim 2 further comprising terminating the printing process after the last set of a last print job of all said subsequent print job has been finished and uploaded from said productivity module.

* * * * *